US007845326B2

(12) United States Patent
Oh

(10) Patent No.: US 7,845,326 B2
(45) Date of Patent: Dec. 7, 2010

(54) VARIABLE VALVE LIFT APPARATUS

(75) Inventor: Chung Han Oh, Yongin (KR)

(73) Assignee: Hyundai Motor Company, Seoul (KR)

( * ) Notice: Subject to any disclaimer, the term of this patent is extended or adjusted under 35 U.S.C. 154(b) by 313 days.

(21) Appl. No.: 12/184,057

(22) Filed: Jul. 31, 2008

(65) Prior Publication Data

US 2009/0151685 A1 Jun. 18, 2009

(30) Foreign Application Priority Data

Dec. 14, 2007 (KR) ..... 10-2007-0131572

(51) Int. Cl.
*F01L 1/14* (2006.01)

(52) U.S. Cl. ..... 123/90.48; 123/90.16; 123/90.44; 123/90.65; 74/569

(58) Field of Classification Search ..... 123/90.16, 123/90.44, 90.48, 90.49, 90.5, 90.52, 90.55, 123/90.65, 90.66, 90.67, 193.3, 193.5; 74/567, 74/569

See application file for complete search history.

(56) References Cited

U.S. PATENT DOCUMENTS 7,484,488 B2 * 2/2009 Cecur et al. ..... 123/90.48

FOREIGN PATENT DOCUMENTS

JP 2007-146844 A 6/2007

* cited by examiner

*Primary Examiner*—Ching Chang
(74) *Attorney, Agent, or Firm*—Morgan, Lewis & Bockius LLP

(57) ABSTRACT

A variable valve lift apparatus according to an exemplary embodiment of the present invention includes an inner body contacting an input cam, an outer body connected with a valve, a lost motion spring disposed between the inner body and the outer body for supplying restoring force to the inner body, a return pin assembly supplying connecting force to the inner body and the outer body, and an operating portion selectively disconnecting the inner body from the outer body.

8 Claims, 6 Drawing Sheets

VARIABLE VALVE LIFT APPARATUS

CROSS-REFERENCE TO RELATED APPLICATION

This application claims priority to and the benefit of Korean Patent Application No. 10-2007-0131572 filed in the Korean Intellectual Property Office on Dec. 14, 2007, the entire contents of which are incorporated herein by reference.

BACKGROUND OF THE INVENTION (a) Field of the Invention

The present invention relates to a variable valve lift apparatus. More particularly, the present invention relates to a variable valve lift apparatus that may realize CDA (cylinder deactivation) with a general cam.

(b) Description of the Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

Recently, a cylinder deactivation apparatus of a vehicle to realize cylinder deactivation function has been under investigation.

In a CDA mode, intake/exhaust valves are deactivated (VDA, valve deactivation), so that a pumping loss may be minimized.

However, the conventional cylinder deactivation apparatus uses a double cam and a variable tappet, so that manufacturing cost is high and manufacturing processes are complicated with many elements.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide a variable valve lift apparatus which may realize CDA with a general cam.

That is, a variable valve lift apparatus according to an example embodiment of the present invention may realize a general valve lift mode and a CDA mode with a simple structure, so that production cost may be reduced and fuel consumption may be improved.

A variable valve lift apparatus according to an example embodiment of the present invention may include an inner body contacting an input cam; an outer body connected with a valve, wherein the outer body slidably encloses the inner body; a lost motion spring disposed between the inner body and the outer body for supplying restoring force to the inner body; a return pin assembly supplying connecting force to the inner body and the outer body; a pin guide formed in a cylinder head and slidably coupling a portion of the return pin assembly; and an operating portion selectively disconnecting the inner body from the outer body by applying an operating force to the inner body according to operating mode, wherein the connecting force of the return pin assembly and the operating force of the operating portion are configured to be applied opposite each other with respect to a rotational axis of the inner body.

The latch may be formed to a lower portion of the inner body along a longitudinal direction of the inner body; a groove may be formed to an upper portion of the outer body along a longitudinal direction of the outer body; and the return pin assembly may be disposed through the outer body and contacts a portion of the inner body.

The return pin assembly may comprise a first return pin body; a second return pin body slidably receiving a portion of the first return pin body; and a return pin spring that is disposed between the first return pin body and the second return pin body.

A first recess portion may be formed to be dented inwards from a portion of the inner body and the inner body contacts via the first recess portion of the return pin assembly inserted through a portion of the outer body.

The second return pin body of the return spring assembly may be slidably coupled to the pin guide.

The operating portion may comprise a hydraulic pin that is selectively operated by hydraulic pressure.

A first recess portion may be formed to be dented inwards from a portion of the inner body and may be contacted to the return pin assembly inserted through a portion of the outer body.

A second recess portion may be formed to be dented inwards and is contacted to the operating portion.

REPRESENTATIVE REFERENCE NUMERALS

Figure 1:
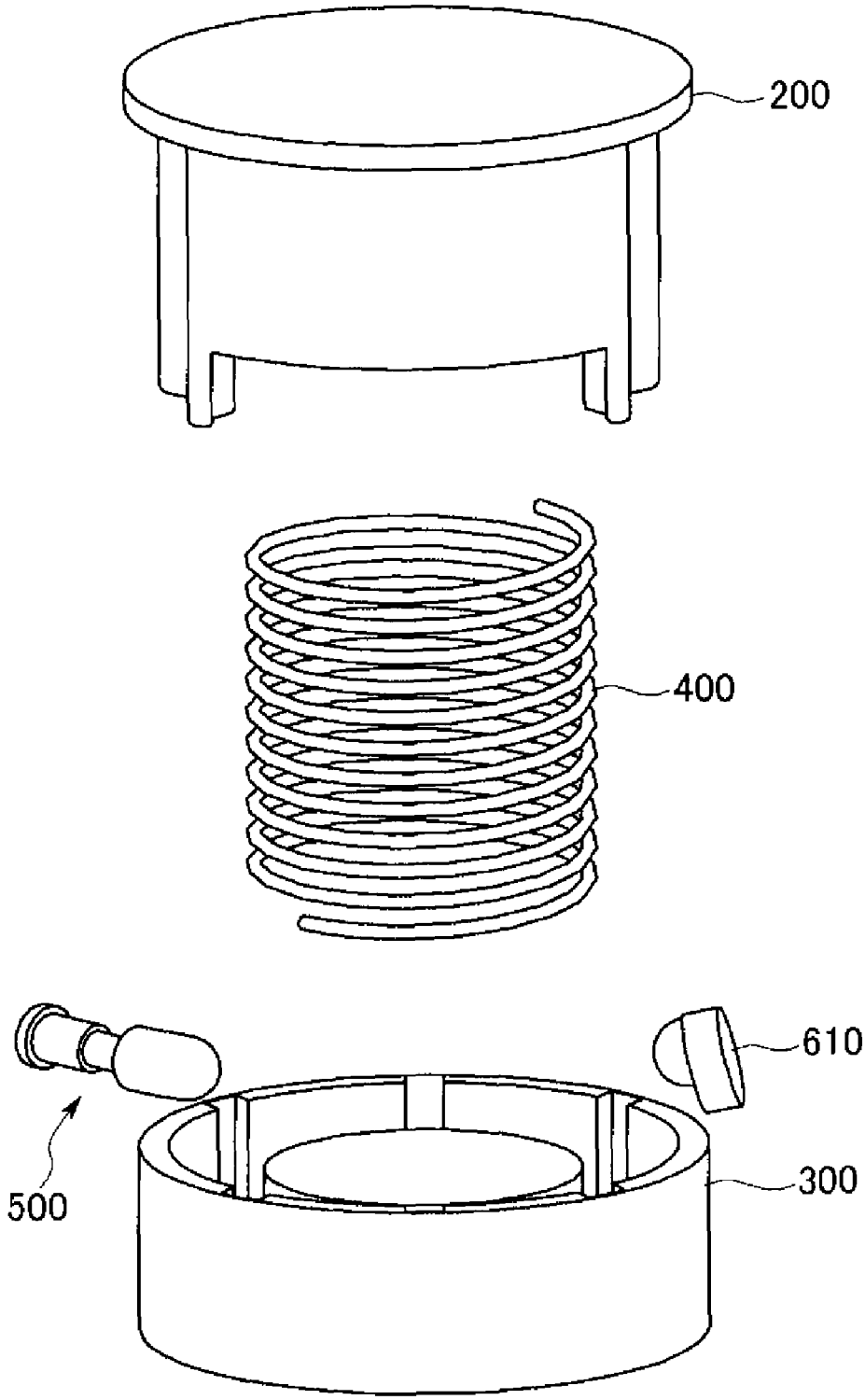
FIG. 1 is an exploded view of a variable valve lift apparatus according to an exemplary embodiment of the present invention.

100: input cam
200: inner body
210: latch
220: first recess portion
230: second recess portion
300: outer body
310: groove
400: lost motion spring
500: return pin assembly
510: first return pin body
520: second return pin body
530: return pin spring
600: operating portion
610: hydraulic pin
620: hydraulic pressure supplying portion
700: valve
800: cylinder head

DETAILED DESCRIPTION OF THE EMBODIMENTS

An exemplary embodiment of the present invention will hereinafter be described in detail with reference to the accompanying drawings.

Figure 2:
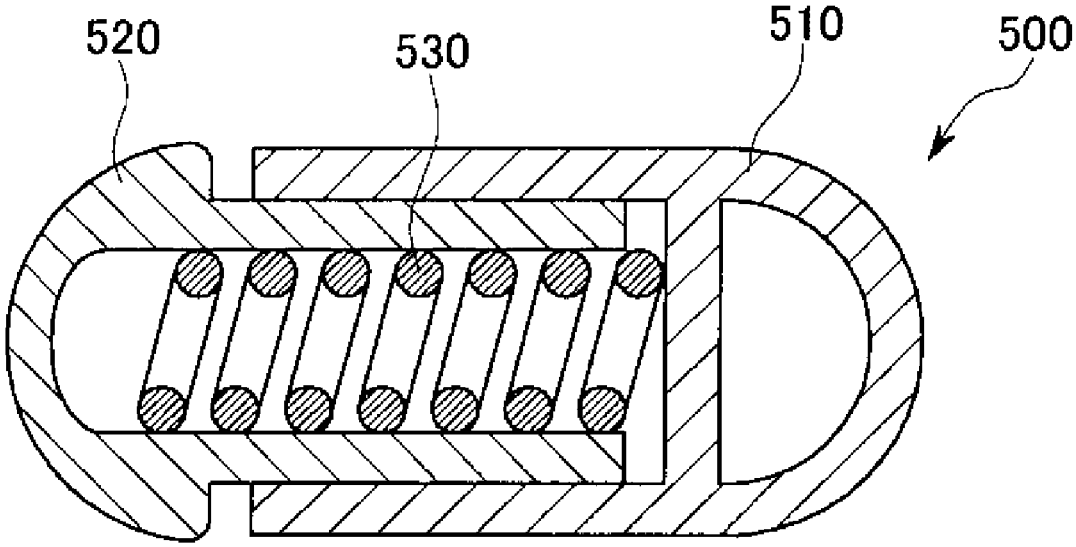
FIG. 2 is a view showing a return pin assembly according to an exemplary embodiment of the present invention.

Referring to FIG. 1 and FIG. 2, a scheme of a variable valve lift apparatus according to an exemplary embodiment of the present invention will be explained.

A variable valve lift apparatus according to an exemplary embodiment of the present invention includes an inner body 200 contacting an input cam 100, an outer body 300 connected with a valve 700, and a lost motion spring 400 disposed between the inner body 200 and the outer body 300 for supplying restoring force to the inner body 200, wherein the inner body 200 is disposed in the outer body 300 and slidably coupled to the outer body 300.

Figure 4:
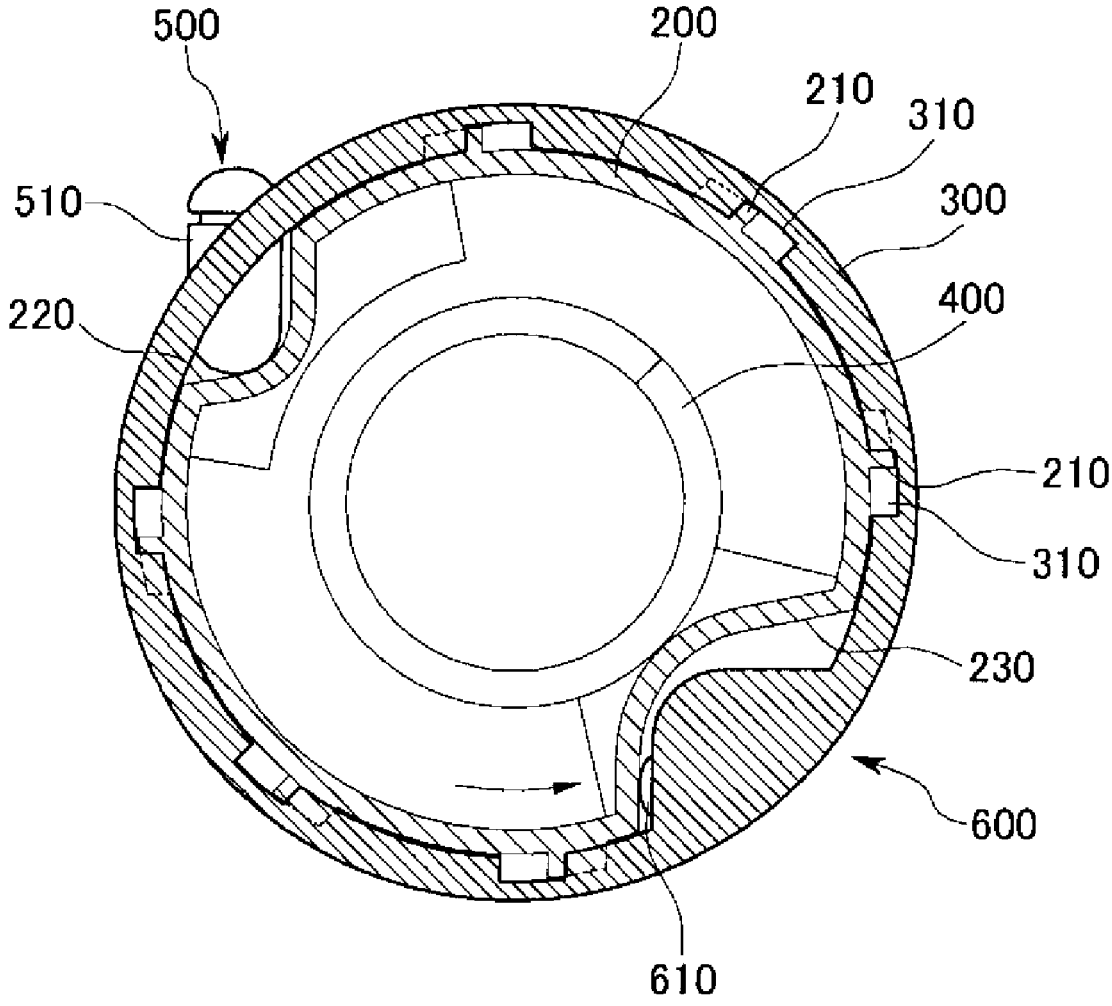
FIG. 4 is a plain cross-sectional view showing an operation of a variable valve lift apparatus according to an exemplary embodiment of the present invention in a general mode of FIG. 3.
Figure 6:
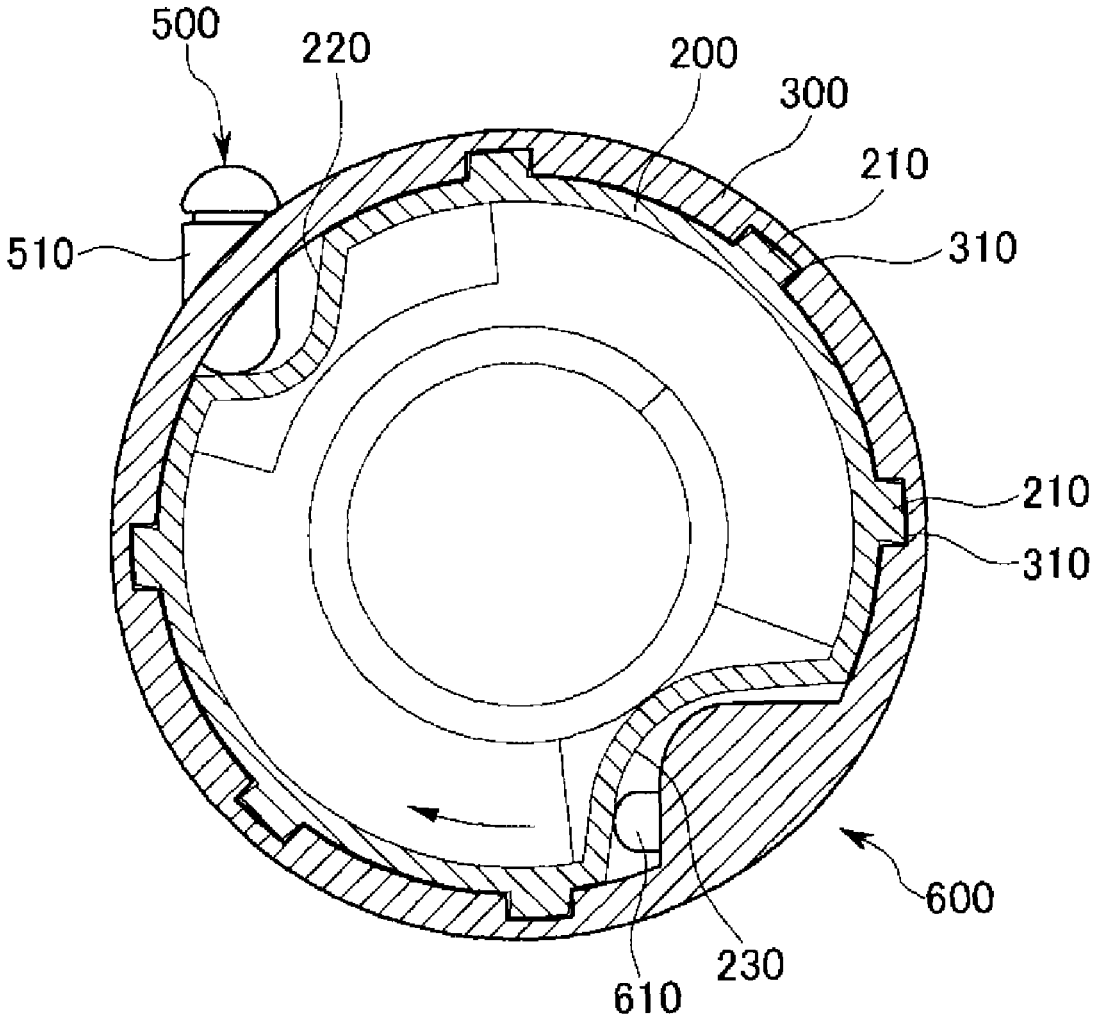
FIG. 6 is a plain cross-sectional view showing an operation of a variable valve lift apparatus according to an exemplary embodiment of the present invention in a CDA mode of FIG. 5.

A return pin assembly 500 is disposed through a portion of the outer body 300 and configured to supply connecting force to the inner body 200, and an operating portion 600 is formed at an inner portion of the outer body 300 and configured to selectively connect the inner body 200 and the outer body 300 according to operating mode. The operating portion 600 is shown in FIG. 4 and FIG. 6 and explained later in detail.

In an exemplary embodiment of the present invention, a latch 210 is formed to an outer circumference of a lower portion of the inner body 200 along a longitudinal direction of the inner body 200, a groove 310 is formed to an inner circumference of an upper portion of the outer body 300 along a longitudinal direction of the outer body 300, and the inner body 200 and the outer body 300 are selectively connected by the return pin assembly 500 according to operating mode In an exemplary embodiment of the present invention, the return pin assembly 500 includes a first return pin body 510, a second return pin body 520 slidably coupled to the first return pin body 510, and a return pin spring 530 that is disposed between the first return pin body 510 and the second return pin body 520.

The operating portion 600 includes a hydraulic pin 610 that is operated by hydraulic pressure.

A first recess portion 220 is formed to be dented inwards and positioned at a portion where the inner body 200 contacts a portion of the first return pin body 510 of the return pin assembly 500.

A second recess portion 230 is formed to be dented inwards and positioned at a portion of the outer body 300 where the inner body 200 is selectively contacted to the hydraulic pin 610 of the operating portion 600 according to the operating mode.

A hydraulic pressure supplying portion 620 selectively supplies hydraulic pressure to the hydraulic pin 610 of the operating portion 600 according to operating mode, and hydraulic pressure supplying portion 620 may be disposed to a cylinder head 800 or to other configuration parts.

The return pin assembly and the hydraulic pressure supplying portion 620 are positioned opposite about the rotational axis of the inner body 200.

Hereinafter operating mode for an operation of a variable valve lift apparatus according to an exemplary embodiment of the present invention will be explained in detail.

Figure 3:
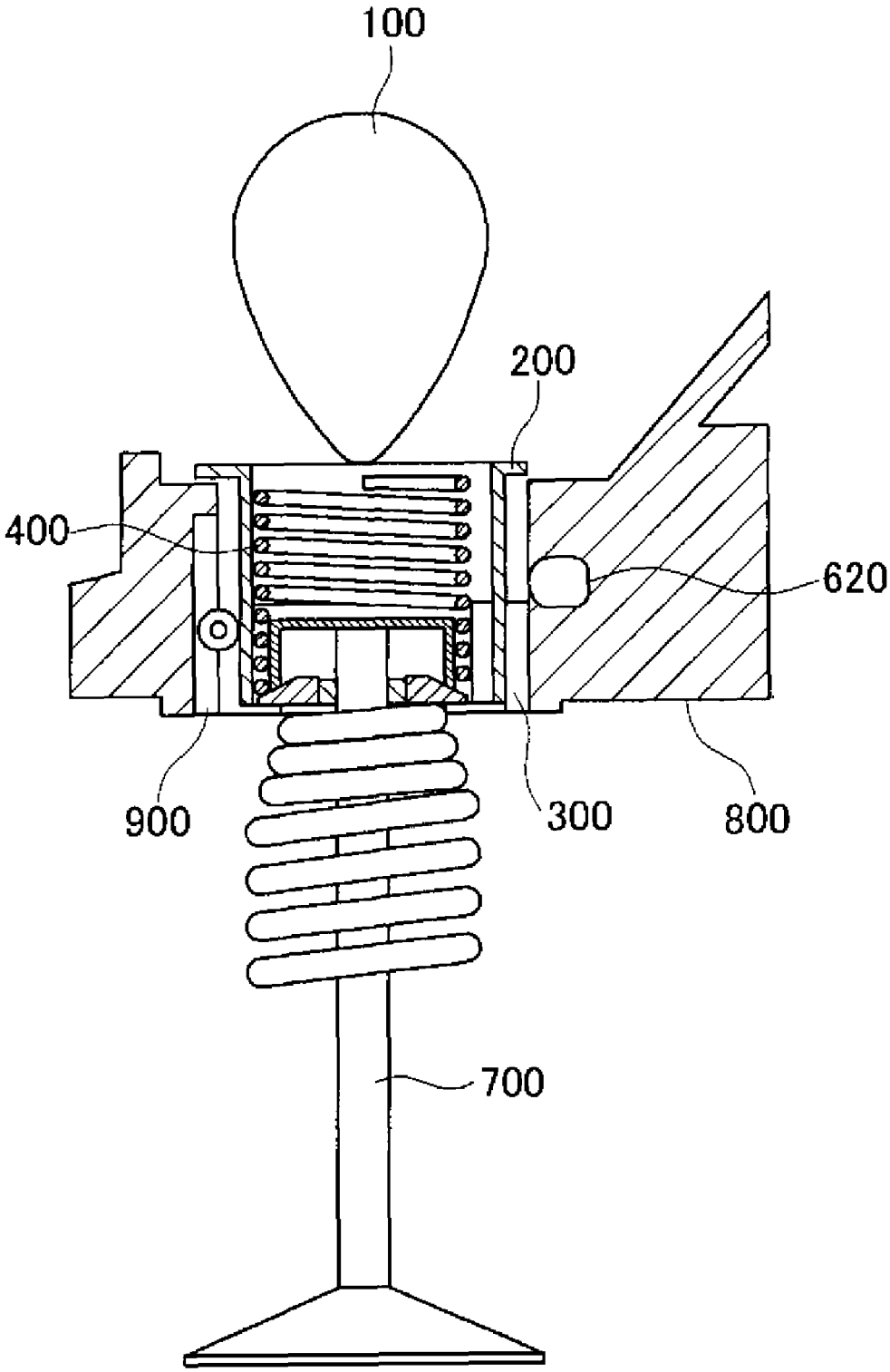
FIG. 3 is a frontal cross-sectional view showing an operation of a variable valve lift apparatus according to an exemplary embodiment of the present invention in a general mode.

FIG. 3 and FIG. 4 are a frontal cross-sectional view and a plain cross-sectional view, respectively, showing an operation of a variable valve lift apparatus according to an exemplary embodiment of the present invention in a general mode.

In a general mode, hydraulic pressure is not supplied to the hydraulic pin 610. Accordingly, the first return pin body 510 of the return pin assembly 500 pushes the first recess portion 200 by elastic force of the return pin spring 530, the inner body 200 is biased counterclockwise along an arrow direction in FIG. 4, and then the latch 210 formed at the lower portion of the inner body 200 and the groove 310 formed at the upper portion of the outer body 300 are connected so that the inner body 200 and the outer body 300 reciprocate integrally according to rotation of the input cam 100.

That is, the variable valve lift apparatus according to an exemplary embodiment of the present invention operates as a conventional valve lift apparatus.

Figure 5:
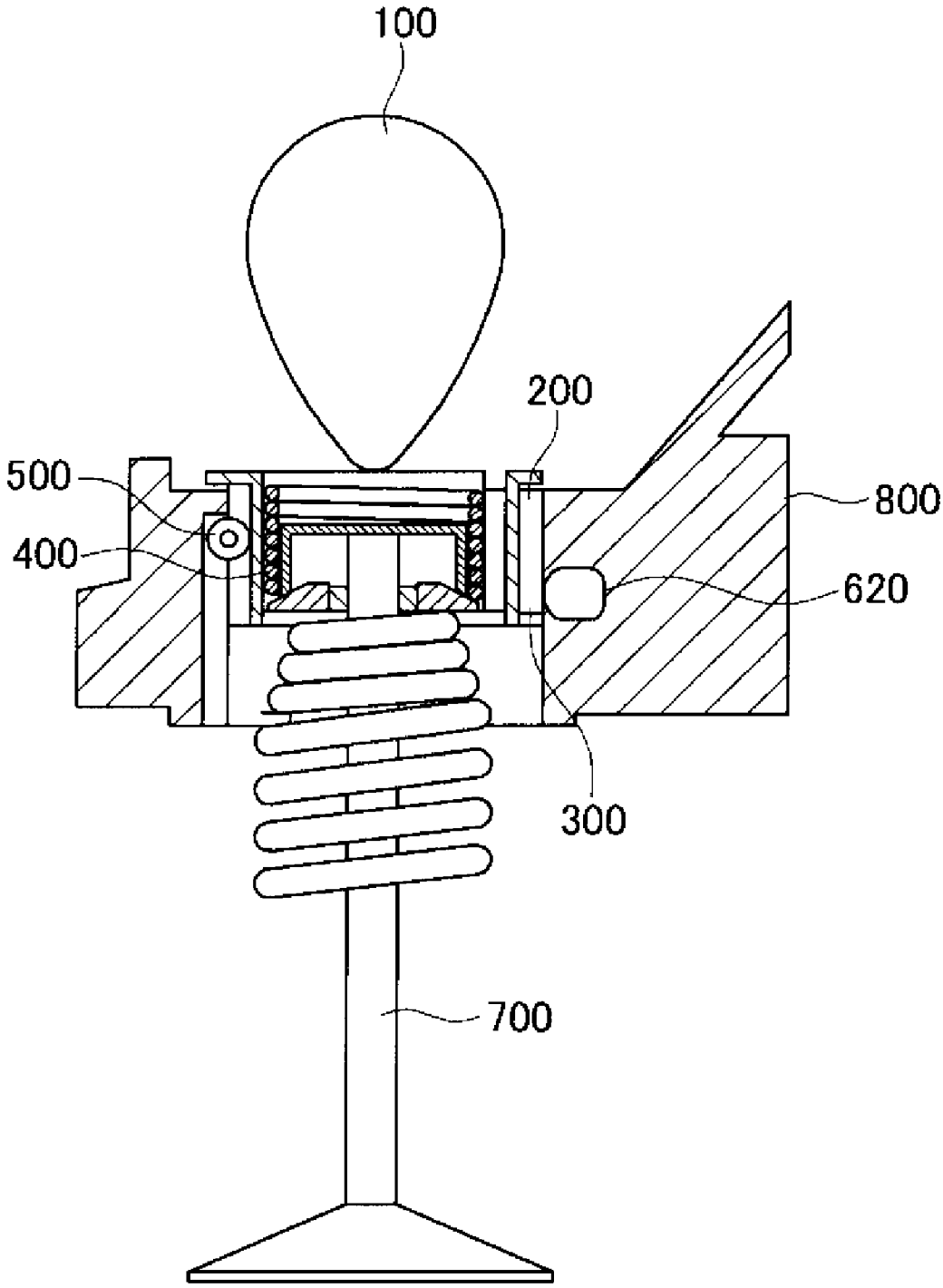
FIG. 5 is a frontal cross-sectional view showing an operation of a variable valve lift apparatus according to an exemplary embodiment of the present invention in a CDA mode.

FIG. 5 and FIG. 6 are a frontal cross-sectional view and a plain cross-sectional view, respectively, showing an operation of a variable valve lift apparatus according to an exemplary embodiment of the present invention in a CDA mode.

Referring to FIG. 5 and FIG. 6, an operation of a variable valve lift apparatus according to an exemplary embodiment of the present invention in a CDA mode will be explained.

In a CDA mode, the hydraulic pressure supplying portion 620 supplies hydraulic pressure to the hydraulic pin 610.

Accordingly, the hydraulic pin 610 pushes the second recess portion 230 in the left direction in the drawing, the inner body 200 is biased clockwise along an arrow direction in FIG. 6, and then the latch 210 of the inner body 200 is disconnected from the groove 310 of the outer body 300. In this configuration, a portion of the second return pin body 520 of the return pin assembly 500 is slidably coupled to a pin guide 900 formed in the cylinder head 800 along a longitudinal direction thereof and thus the outer body 300 disconnected from the inner body 200 slidably moves upwards over the inner body 200 as shown in FIG. 5. The inner body 200 disconnected from the outer body 300 has lost motion, so the valve 700 is not opened.

That is, the variable valve lift apparatus according to an exemplary embodiment of the present invention performs CDA operation.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve lift apparatus comprising:

an inner body contacting an input cam;

an outer body connected with a valve, wherein the outer body slidably encloses the inner body;

a lost motion spring disposed between the inner body and the outer body for supplying restoring force to the inner body;

a return pin assembly supplying connecting force to the inner body and the outer body;

a pin guide formed in a cylinder head and slidably coupling a portion of the return pin assembly; and an operating portion selectively disconnecting the inner body from the outer body by applying an operating force to the inner body according to operating mode, wherein the connecting force of the return pin assembly and the operating force of the operating portion are configured to be applied opposite each other with respect to a rotational axis of the inner body.

2. The variable valve lift apparatus of claim 1, wherein:

a latch is formed to a lower portion of the inner body along a longitudinal direction of the inner body;

a groove is formed to an upper portion of the outer body along a longitudinal direction of the outer body; and the return pin assembly is disposed through the outer body and contacts a portion of the inner body.

3. The variable valve lift apparatus of claim 2, wherein the return pin assembly comprises:

a first return pin body;

a second return pin body slidably receiving a portion of the first return pin body; and a return pin spring that is disposed between the first return pin body and the second return pin body.

4. The variable valve lift apparatus of claim 3, wherein a first recess portion is formed to be dented inwards from a portion of the inner body and the inner body contacts via the first recess portion of the return pin assembly inserted through a portion of the outer body.

5. The variable valve lift apparatus of claim 3, wherein the second return pin body of the return spring assembly is slidably coupled to the pin guide.

6. The variable valve lift apparatus of claim 1, wherein the operating portion comprises a hydraulic pin that is selectively operated by hydraulic pressure.

7. The variable valve lift apparatus of claim 1, wherein a first recess portion is formed to be dented inwards from a portion of the inner body and is contacted to the return pin assembly inserted through a portion of the outer body.

8. The variable valve lift apparatus of claim 1, wherein a second recess portion is formed to be dented inwards and is contacted to the operating portion.

* * * * *